US010954611B2

(12) United States Patent
Rathnayake

(10) Patent No.: US 10,954,611 B2
(45) Date of Patent: Mar. 23, 2021

(54) RELATING TO TEXTILES INCORPORATING ELECTRONIC DEVICES

(71) Applicant: ADETEXS LTD, Nottingham (GB)

(72) Inventor: Anura Sarathchandra Rathnayake, Nottingham (GB)

(73) Assignee: ADETEXS LTD, Nottingham (GB)

( * ) Notice: Subject to any disclaimer, the term of this patent is extended or adjusted under 35 U.S.C. 154(b) by 212 days.

(21) Appl. No.: 16/091,122

(22) PCT Filed: Apr. 7, 2017

(86) PCT No.: PCT/GB2017/050980
§ 371 (c)(1),
(2) Date: Oct. 4, 2018

(87) PCT Pub. No.: WO2017/175001
PCT Pub. Date: Oct. 12, 2017

(65) Prior Publication Data

US 2020/0325602 A1 Oct. 15, 2020

(30) Foreign Application Priority Data

Apr. 7, 2016 (GB) ..... 1605925

(51) Int. Cl.
*D02G 3/44* (2006.01)
*D02G 3/12* (2006.01)
*D02G 3/36* (2006.01)

(52) U.S. Cl.
CPC ..... *D02G 3/441* (2013.01); *D02G 3/12* (2013.01); *D02G 3/36* (2013.01); *D10B 2401/18* (2013.01)

(58) Field of Classification Search
CPC . D02G 3/12; D02G 3/36; D02G 3/441; D10B 2401/18
See application file for complete search history.

(56) References Cited

U.S. PATENT DOCUMENTS 6,329,917 B1 * 12/2001 Leonard ..... D02G 3/441 340/572.7
6,412,701 B1 7/2002 Kohama
7,592,276 B2 * 9/2009 Hill ..... D03D 11/00 442/301

(Continued)

FOREIGN PATENT DOCUMENTS

CN 101221037 A 7/2008
DE 202014100158 U1 2/2014

(Continued)

OTHER PUBLICATIONS

International Search Report for PCT/GB2017/050980; International Filing Date: Apr. 7, 2017.

(Continued)

*Primary Examiner* — Shaun R Hurley
(74) *Attorney, Agent, or Firm* — Schmeiser, Olsen & Watts, LLP

(57) ABSTRACT

A fiber for incorporation into a textile has an electronic device, and an electrical conductor connected to the electronic device is provided. The electrical conductor extends along a longitudinal axis of the fiber, and the electronic device and the electrical conductor are encapsulated by a unitary body of at least a first material.

20 Claims, 6 Drawing Sheets

(56) References Cited

U.S. PATENT DOCUMENTS

| | | | | |
|---|---|---|---|---|
| 8,814,054 | B2 * | 8/2014 | Brun | H01L 24/85 235/492 |
| 9,142,524 | B2 | 9/2015 | Kyozuka | |
| 10,480,104 | B2 * | 11/2019 | Fu | D03D 1/0088 |
| 2004/0057176 | A1 * | 3/2004 | Dhawan | D02G 3/38 361/62 |
| 2004/0115430 | A1 | 6/2004 | Leonard | |
| 2007/0145037 | A1 | 6/2007 | Hsiung et al. | |
| 2008/0220678 | A1 * | 9/2008 | Neudeck | C09K 11/08 442/110 |
| 2009/0025819 | A1 * | 1/2009 | Douglas | D02G 3/441 139/420 R |
| 2009/0053950 | A1 | 2/2009 | Surve | |
| 2009/0139198 | A1 | 6/2009 | Dias et al. | |
| 2013/0033879 | A1 * | 2/2013 | Vicard | D03D 9/00 362/382 |
| 2013/0092742 | A1 * | 4/2013 | Brun | H01L 24/85 235/492 |
| 2017/0016154 | A1 | 1/2017 | Deschamps | |
| 2017/0107647 | A1 * | 4/2017 | Riethmuller | D03D 1/0076 |
| 2017/0275789 | A1 * | 9/2017 | Dias | D02G 3/441 |
| 2017/0319844 | A1 | 11/2017 | Woo | |
| 2017/0325337 | A1 | 11/2017 | Karagozler et al. | |
| 2018/0116592 | A1 * | 5/2018 | Lim | H01L 51/055 |
| 2018/0355524 | A1 * | 12/2018 | Brun | D02G 3/38 |
| 2019/0003084 | A1 * | 1/2019 | Dias | H05K 1/189 |
| 2019/0273199 | A1 * | 9/2019 | Tajitsu | D04B 21/20 |

FOREIGN PATENT DOCUMENTS

| | | | |
|---|---|---|---|
| DE | 202014100158 | U1 | 10/2014 |
| EP | 1186032 | A2 | 3/2002 |
| EP | 2314744 | A2 | 4/2011 |
| EP | 3076769 | A1 | 10/2016 |
| FR | 3038210 | A1 | 1/2017 |
| GB | 252900 | A | 6/1926 |
| GB | 2529900 | A | 6/1926 |
| GB | 2426255 | A | 11/2006 |
| GB | 2472025 | A | 1/2011 |
| GB | 2472026 | A | 1/2011 |
| JP | 5274082 | A | 10/2009 |
| JP | 5274082 | B2 | 10/2009 |
| JP | 2013-189718 | A | 9/2013 |
| JP | 2015078967 | A | 4/2015 |
| KR | 101798192 | A | 6/2017 |
| WO | 02084617 | A1 | 10/2002 |
| WO | WO 02/084617 | A1 | 10/2002 |
| WO | 03094719 | A1 | 11/2003 |
| WO | WO 03/094719 | A1 | 11/2003 |
| WO | 2016038342 | A1 | 3/2016 |
| WO | WO 2016/038342 | A1 | 3/2016 |
| WO | 17175001 | A1 | 10/2017 |
| WO | 2017175001 | A1 | 10/2017 |

OTHER PUBLICATIONS

Written Opinion for PCT/GB2017/050980; International Filing Date: Apr. 7, 2017.

UKIPO Search Report dated Feb. 28, 2017 for Application No. GB1605925.5.

International Search Report dated Jul. 28, 2017 for PCT/GB2017/050980; International Filing Date: Apr. 7, 2017.

Written Opinion dated Jul. 28, 2017 for PCT/GB2017/050980; International Filing Date: Apr. 7, 2017.

* cited by examiner

RELATING TO TEXTILES INCORPORATING ELECTRONIC DEVICES

CROSS-REFERENCE TO RELATED APPLICATIONS

This application claims priority to PCT Application No. PCT/GB2017/050980, having a filing date of Apr. 7, 2017, based on GB Application No. 1605925.5, having a filing date of Apr. 7, 2016, the entire contents both of which are hereby incorporated by reference.

FIELD OF TECHNOLOGY

The following relates to incorporation of electronic devices into textiles.

BACKGROUND

Fabric is typically woven or knitted using yarn, which is commonly formed from twisted fibers of materials such as wool or nylon. It has previously been proposed to utilise yarns which incorporate electronic devices.

An example of such a yarn is disclosed in US 2009/139,198. The yarn of US 2009/139,198 comprises electronic components housed in resin, with conductive devices twisted around the resin to form the outer surface of the yarn. This may result in the conductive devices being exposed to the external environment, and may result in damage to the conductive devices.

Another example of such a yarn is disclosed in GB 2529900. The yarn of GB 2529900 comprises a series of electronic devices held on carriers, with each of the electronic devices being housed in an individual pod of resin. The series of electronic devices are connected by conductive interconnects. The individual pods of resin are held within packing fibers, which are in turn held within a retaining sleeve formed of wound or braided threads.

Although the yarn of GB 2529900 provides an electronically functional yarn which can be incorporated into a garment, there are nevertheless disadvantages associated with such yarn. In particular, when the yarn is bent, gaps can appear between packaging fibers and also between the fibers that form the retaining sleeve. This may result in the conductive interconnects that extend between electronic devices being exposed to the external environment, and may result in damage to the conductive interconnects. Furthermore, the presence of packaging fibers and a retaining sleeve can interfere with the function performed by the electronic device.

There has now been devised a fiber for incorporation into a textile, a textile incorporating such a fiber, and methods of manufacturing a fiber and a textile, which overcome or substantially mitigate the aforementioned and/or other disadvantages associated with the prior art.

SUMMARY

According to a first aspect of embodiments of the present invention there is provided a fiber for incorporation into a textile, the fiber comprising an electronic device, and an electrical conductor connected to the electronic device and extending along a longitudinal axis of the fiber, wherein the electronic device and the electrical conductor are encapsulated by a unitary body of at least a first material.

The fiber according to the first aspect of embodiments of the present invention is beneficial principally as the electronic device and the electrical conductor are encapsulated by a unitary body of at least a first material, such as a plastics material. In particular, by encapsulating the electronic device and the electrical conductor in a unitary body of at least a first material, the electrical conductor may be protected from the external environment by, for example, reducing the risk of the electrical conductor being exposed to the external environment when a fiber is manipulated or bent during use. For example, the electronic device and the electrical conductor may be hermetically sealed relative to the surroundings by the unitary body. The unitary body may comprise more than one material, but those materials are not separable from each other, such that a unitary body is formed.

The unitary body may comprise a first material that encapsulates both the electronic device and the electrical conductor, or a first material that encapsulates the electronic device that is bonded to a second material that encapsulates the conductor, thereby forming a unitary body that encapsulates both the electronic device and the electrical conductor. This arrangement may remove the need for use of further materials to enclose the electronic device, which may result in a structure which is simpler and less expensive to manufacture than yarns incorporating electronic devices which are known in the prior art. Alternatively, the unitary body may comprise a plurality of materials, eg in a layered structure, in order to provide specific desired properties.

The fiber may have a length which is larger than its width and/or diameter. The fiber may have a length which is at least 5 times, at least 10 times, at least 25 times, at least 50 times, at least 100 times, at least 250 times, at least 500 times, at least 750 times, or at least 1000 times larger than its width or diameter. The fiber may have a length which is at least 5 times, at least 10 times, at least 25 times, at least 50 times, at least 100 times, at least 250 times, at least 500 times, at least 750 times, or at least 1000 times larger than a length of the electronic device.

At least a portion of the fiber may comprise a cross-sectional area of substantially constant shape along its length. By cross-sectional area is meant the area visible when a cut is taken substantially orthogonal to a longitudinal axis of the fiber. At least a portion of the fiber may comprise a circular or polygonal, for example triangular, square, rectangular, pentagonal etc, cross-sectional area. At least a portion of the fiber may comprise a substantially constant cross-sectional area, for example a cross-sectional area of constant size and/or shape.

The unitary body may comprise an inner layer, eg of at least a first material, which may be in contact with the electronic device and/or the conductor, and an outer layer that extends about the inner layer. The inner layer may be adapted to protect the electronic device and/or the conductor, and hence may have a greater rigidity, a greater thermal resistance and/or a greater electrical resistance relative to the outer layer. The material of the outer layer may be chosen as a material having an inherently greater flexibility relative to the inner layer, thereby enabling the outer layer to have a greater thickness relative to the inner layer, for example.

During manufacture, the inner layer of the unitary body may be cured initially, before the outer layer is applied and then cured. The inner layer may therefore be cured fully, in order to reduce the risk of uncured portions providing weaknesses in the unitary body, before the outer body is applied and then cured. The inner layer may be cured in any conventional manner, eg by heat or by exposure to electromagnetic radiation, eg UV radiation. The material of the inner layer may therefore by at least translucent or transparent.

The inner layer may, for example, comprise epoxy resin. The outer layer may, for example, comprise any of polyurethane or liquid silicon elastomer. However, other materials are also contemplated.

The fiber may comprise first and second free ends. The fiber may comprise a cross-sectional area of substantially constant size and/or shape between the first and second free ends. The fiber may comprise a region of increased cross-sectional area in at least a region of the electronic device, relative to the cross-sectional area of the remainder of the fiber, eg the cross-section along the majority of the conductor. For example, the first material may comprise an increased thickness in a region of the electronic device relative to the thickness of the remainder of the fiber. A thicker region of the first material may be beneficial as this may provide increased structural rigidity and/or increased resistance to heat/pressure in the region of the electronic device.

The fiber may be elongate and substantially cylindrical in form. The fiber may have a global form which is substantially similar to, for example, a wire or other thin and elongate members. The fiber may have a length of at least 10 cm, at least 25 cm, at least 50 cm, or at least 100 cm. The fiber may have a width or diameter of at most 1000 μm, at most 900 μm, at most 800 μm, at most 500 μm, or at most 200 μm. The electronic device may have a width and/or height and/or depth of at most 2000 μm, at most 700 μm, at most 600 μm, at most 500 μm, at most 300 μm, or at most 100 μm. The fiber may have a width or diameter which is at least 200%, at least 300%, at least 400%, or at least 500% of the width or diameter of the electrical conductor.

The fiber may comprise a filament fiber, for example a fiber of continuous or near continuous length. The device may comprise a staple fiber, for example a fiber of discrete length. A staple fiber may comprise a filament fiber which has been cut into discrete lengths.

The volume of the first material may be at least 50%, at least 60%, at least 70%, at least 80%, or at least 90%, of the total volume of the fiber.

The unitary body may form at least a portion of an outermost surface of the fiber. The unitary body may form at least a portion of the perimeter of a cross-section taken orthogonally relative to a longitudinal axis of the fiber, for example at least a portion of the circumference of a cross-section of the fiber. The unitary body may form the entirety of an outermost surface of the fiber.

The unitary body may define a substantially continuous surface. For example, the unitary body may define a surface which is uninterrupted by gaps or holes or the like. The unitary body may define the outer surface of a cylinder. The unitary body may define a substantially continuous outer surface of the fiber.

The electronic device may encapsulated by a first body of a first material, and at least a portion of the electrical conductor may be encapsulated by a second body of a second material. The electronic device and the electrical conductor may be encapsulated by a first body of a first material and a second body of a second material. For example, the electronic device may be encapsulated by a first body of a first material and the electrical conductor may be encapsulated by a second body of a second material. At least a portion of the electrical conductor may be encapsulated by a first body of a first material and/or at least a portion of the electrical conductor may be encapsulated by a second body of a second material.

The first material and the second material may comprise different material properties. The first material may have a higher thermal resistance than the second material, or vice versa. The first material may have a higher electrical conductivity than the second material, or vice versa.

The unitary body may encapsulate the electronic device and/or the conductor, such that there is no air gap between the electronic device and/or the conductor, and the unitary body. The fiber may be structured such that there is no air gap between the electronic device and/or the conductor, and an outer surface of the fiber. Solid material may extend between the electronic device and an outer surface of the fiber. For example, the unitary body may extend between the electronic device and an outer surface of the fiber. Such an arrangement may be beneficial as the removal of air gaps from the material structure of the fiber may improve transmission of signals, for example thermal signals, to the electronic device from the external environment of the fiber.

The fiber may be flexible in nature. The fiber may be malleable or resiliently deformable. The unitary body may comprise a flexible material or a rigid material.

The fiber may comprise a reinforcing member for reinforcing the fiber. The reinforcing member may comprise a thread extending along a longitudinal axis of the fiber. The reinforcing member may comprise a thread extending along substantially the entirety of a longitudinal axis of the fiber, for example at least 70%, at least 80%, at least 90%, or 100% of a longitudinal axis of the fiber. The reinforcing member may comprise a non-electrically conducting material, for example a material which is significantly less electrically conductive than the electrical conductor, for example having less than 1% of the electrical conductivity of the electrical conductor. The reinforcing member may be a separate component to the electrical conductor.

The reinforcing member may comprise a plastics material. The reinforcing member may comprise a thermoplastic material. The reinforcing material may comprise a synthetic polymer. The reinforcing member may, for example, comprise polyester, nylon, liquid crystal polymers, aramid fiber. Suitable commercially available materials include Vectran®, Kevlar®, Zylon® and monofilament.

The first material may comprise a resin, for example a plant-derived or synthetic resin. The resin will typically be a plastics material, and may be a thermoplastic material. The first material may be thermally conductive, and may be more thermally conductive than conventional yarn. For example, the first material may have a thermal conductivity of at least 0.1 W/(m·K). The first material may comprise any of: silicone elastomer; epoxy resin; polyester resin; polyurethane; or acrylic, for example.

The first material may fix the relative positions of the electronic device and/or the electrical conductor and/or the reinforcing member. The electrical conductor may comprise a flexible material, which may be a malleable material. The electrical conductor may be fixed to the reinforcing member, for example prior to encapsulation by the first material. The electrical conductor may be wound around the reinforcing element, for example in a helical fashion. This may be beneficial as an applied stretching force may stretch the fiber without placing stress on the electrical conductor. For example, the wound nature of the electrical conductor may allow for expansion of the electrical conductor along a longitudinal axis of the fiber without causing deformation of the electrical conductor. The electrical conductor may comprise a wire, for example an electrically conducting wire.

The electrical conductor may comprise copper, and may, for example, comprise copper wire.

The electrical conductor may extend along substantially the entirety of the length of the fiber, for example between first and second free ends of the fiber. The electrical conductor may, for example, comprise an antenna for an RFID device.

The electronic device may comprise a sensor, such as a temperature sensor, an accelerometer and/or a proximity sensor. The electronic device may comprise an integrated circuit, which may function as a controller. The electronic device may comprise a transmitter and/or a receiver of electrical or electromagnetic signals, or other type of input and/or output device, such as a light sensor and/or a light source, for example an LED. The electronic device may comprise an RFID (Radio Frequency ID) chip or an NFC (Near-Field Communication) chip.

The electronic device may comprise memory for storing data, and may be readable and/or writable, as required by the particular application.

The fiber may comprise a plurality of electronic devices, and may for example, comprise a plurality of electronic devices spaced apart along the length of the fiber. Each of the plurality of electronic devices may be connected to at least one electrical conductor. The plurality of electronic devices may comprise electronic devices having different sizes and/or different functions.

Each electrical conductor may connect to only one electronic device, and may comprise a connection at one end thereof for connection to an output device not encapsulated by the first material.

Each electrical conductor may connect to a plurality of electronic devices, each of the plurality of electronic devices being encapsulated by the first material.

The plurality of electronic devices and the electrical conductors may be encapsulated by the unitary body. The electrical conductors may be encapsulated by the unitary body along the entire length of the electrical conductors. In such a fashion, an electrical conductor extending between electronic devices may be completely encapsulated by the unitary body.

Where the fiber contains a plurality of electrical conductors, the plurality of electrical conductors may be electrically insulated from one another, for example to prevent the occurrence of short-circuits. The unitary body may electrically insulate the plurality of electrical conductors from one another. The unitary body may comprise an electrically insulating material. The plurality of electrical conductors may comprise an electrically insulating coating. The plurality of electrical conductors may be pre-coated with an electrically insulating material prior to encapsulation by the first material.

According to a second aspect of embodiments of the present invention there is provided a textile comprising a fiber according to the first aspect of embodiments of the present invention.

The textile may comprise a garment, which may, for example, comprise outerwear or underwear.

The fiber may be attached to the textile, and may, for example, be attached to an interior surface of a garment. The fiber may be attached to the textile using adhesive. For example, the fiber may be attached to adhesive fabric tape, which may be adhered to a textile. Where the fiber comprises a sensor, the fiber may comprise a blocking element for blocking unwanted signals. Where the fiber comprises a temperature sensor, a non-body facing surface of the temperature sensor may be thermally insulated from the ambient environment. For example, a surface of a garment and/or a surface of the adhesive fabric tape, in a region of the temperature sensor, may comprise a thermally insulating material.

Where the textile comprises a garment, the fiber may be attached to the garment such that the electronic device is exposed to the body of a user. For example, the fiber may be attached to the garment such that the electronic device is in thermal contact with the body of a user.

According to a third aspect of embodiments of the present invention there is provided a method of manufacturing a fiber for incorporation into a textile, the method comprising connecting an electrical conductor to an electronic device, encapsulating the electronic device and the electrical conductor in a unitary body of at least a first material, such that the electrical conductor extends along a longitudinal axis of the fiber.

The method may comprise coating the electronic device and electrical conductor in a first liquid material, and solidifying the first liquid material such that the electronic device and the electrical conductor are encapsulated by a unitary body of the first material.

The first liquid material may be held in a bath, for example a reservoir of the first liquid material, and the electronic device and electrical conductor may be dipped in the bath to coat the electronic device and electrical conductor in the first liquid material.

The first liquid material may be solidified by curing, and may, for example, be solidified by exposure to UV light, or exposure to heat, or exposure to hot air. The first liquid material may comprise a resin. The first liquid material may comprise a resin, for example a plant-derived or synthetic resin. The resin will typically be a plastics material, and may be a thermoplastic material. The first liquid material may be thermally conductive, and may be more thermally conductive than conventional yarn. For example, the first liquid material may have a thermal conductivity of at least 0.1 W/(m·K). The first liquid material may comprise any of: silicone rubber; epoxy resin; polyester resin; polyurethane; or acrylic.

The method may comprise coating the electronic device in a first liquid material and coating the electrical conductor in a second liquid material, and solidifying the first and second liquid materials, such that the electronic device and the electrical conductor are encapsulated by the first and second materials respectively. The method may comprise coating at least a portion of the electrical conductor in a first liquid material, coating at least a portion of the electrical conductor in a second liquid material, and solidifying the first and second liquid materials such that the electrical conductor is encapsulated by the first and second materials. The first and second materials may comprise multiple layers of material.

The method may comprise providing a reinforcing member to the electronic device and/or electrical conductor prior to encapsulating the electronic device and electrical conductor in a first and/or second liquid material. The method may comprise fixing the electrical conductor to the reinforcing member. The method may comprise winding the electrical conductor around the reinforcing member, for example in a helical fashion.

According to a fourth aspect of embodiments of the present invention there is provided a method of manufacturing a textile, the method comprising incorporating a fiber according to the first aspect of embodiments of the present invention into the textile.

The method may comprise attaching a fiber according to the first aspect of embodiments of the present invention to a textile, for example by any or any combination of: sewing or inserting the fiber into the textile, for example into a hem, side seam, or collar of a garment; adhering the fiber to the textile, either directly or indirectly, using an adhesive, such as an adhesive fabric tape; weaving the fiber into the textile; embroidering the fiber into the textile; knitting the fiber into the textile; or inserting the fiber into the structure of a woven/knitted/non-woven textile.

Preferential features of each aspect of embodiments of the present invention may be applied to other aspects of embodiments of the present invention, where appropriate.

BRIEF DESCRIPTION

Some of the embodiments will be described in detail, with references to the following Figures, wherein like designations denote like members, wherein.

DETAILED DESCRIPTION

Figure 1:
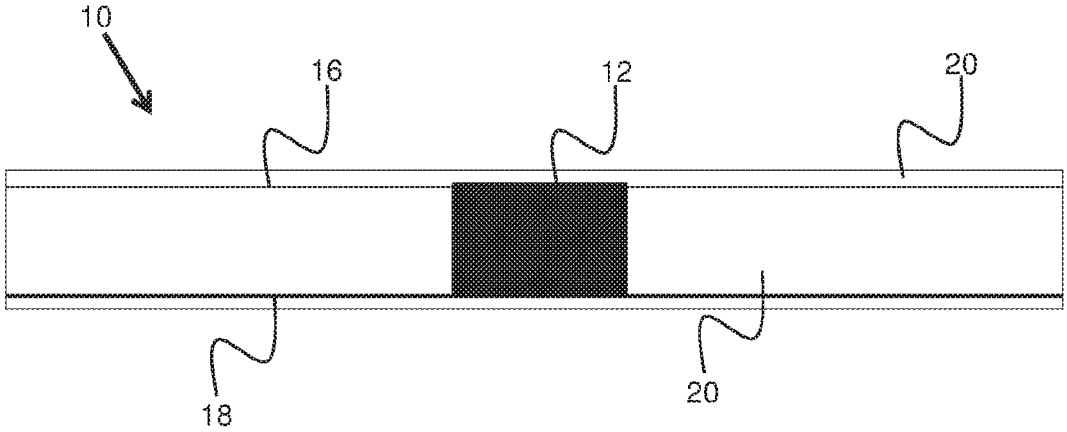
FIG. 1 is a schematic longitudinal sectional view of a fiber according to a first embodiment of a first aspect of the present invention.
Figure 2:
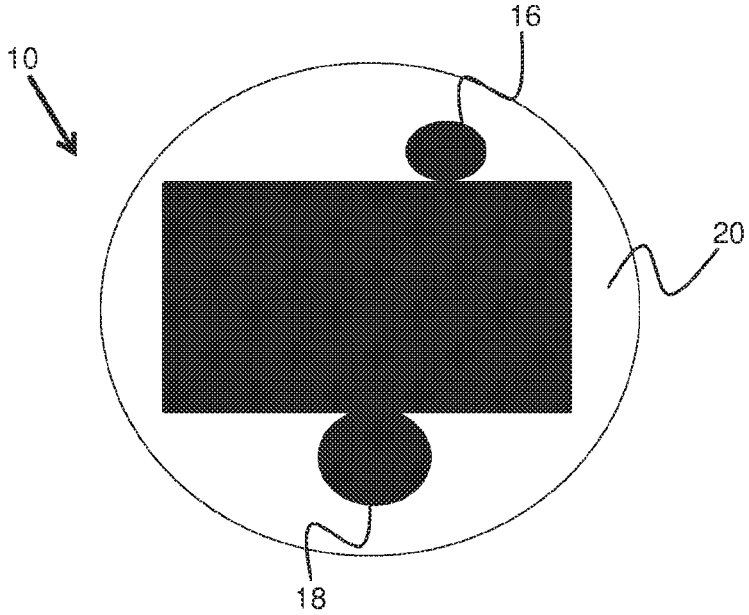
FIG. 2 is a schematic cross-sectional view of the fiber of FIG. 1.

A fiber, generally designated 10, according to a first aspect of embodiments of the present invention, is shown schematically in FIGS. 1 and 2.

The fiber 10 comprises an electronic device 12, an electrical conductor 16, a reinforcing thread 18, and a resin body 20. The fiber 10 is in the region of 1 m long.

The electronic device 12 may be any appropriate electronic device, but in the present case is a temperature sensor 12. The temperature sensor 12 has a maximum dimension of 500 μm or 300 μm. The electrical conductor 16 is formed from copper wire, and is electrically connected to an appropriate contact point on the temperature sensor 12. The electrical conductor 16 extend across the entire length of the fiber 10, as shown in FIG. 1.

The reinforcing thread 18 is attached to the temperature sensor 12, and extends across the entire length of the fiber 10, as shown in FIG. 1. The reinforcing thread 18 may be formed of any material sufficient to reinforce the fiber 10, and in the present case is formed from nylon.

The resin body 20 encapsulates each of the temperature sensor 12, the electrical conductor 16, and the reinforcing thread 18, such that the resin body 20 forms an outermost layer of the fiber 10. In this manner, the resin body 20 prevents exposure of the remaining components to the external environment of the fiber 10. Furthermore, and as seen in FIG. 1, the resin body 20 forms a main body of the fiber 10 along the length of the fiber 10.

Figure 3:
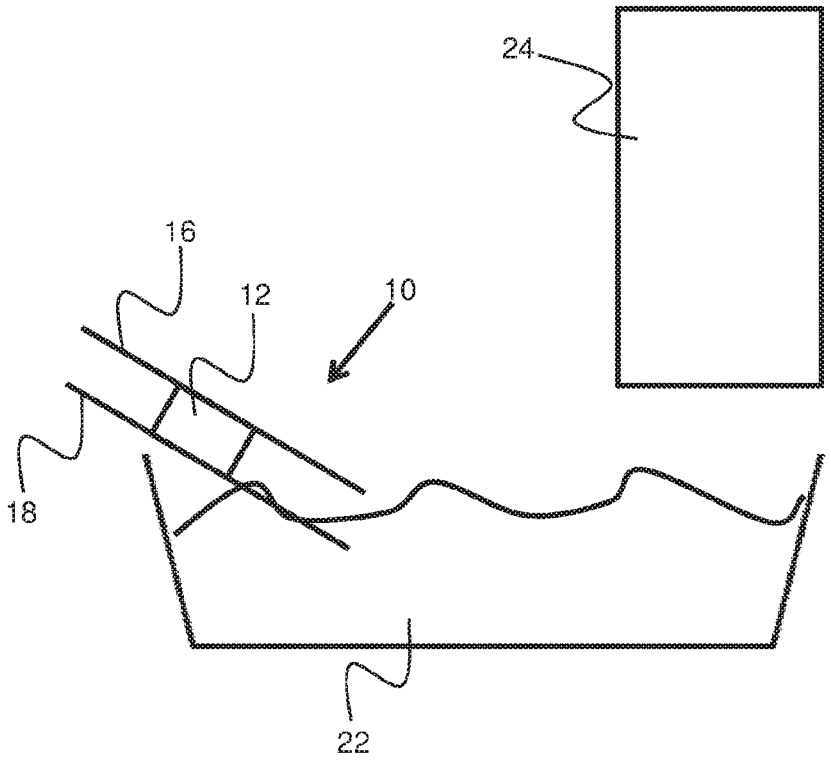
FIG. 3 is a schematic view illustrating a method of manufacturing the fiber of FIGS. 1 and 2.

A method of manufacturing the fiber 10 is shown schematically in FIG. 3. Initially, the electrical conductor 16 and the reinforcing thread 18, are connected to the temperature sensor 12. This combined structure is dipped into a resin bath 22, and subsequently passed to a curing station 24. The curing station 24 utilises a suitable form of curing, for example applying heat, UV light, or hot air, to cure the resin, thereby forming the resin body 20.

Figure 4:
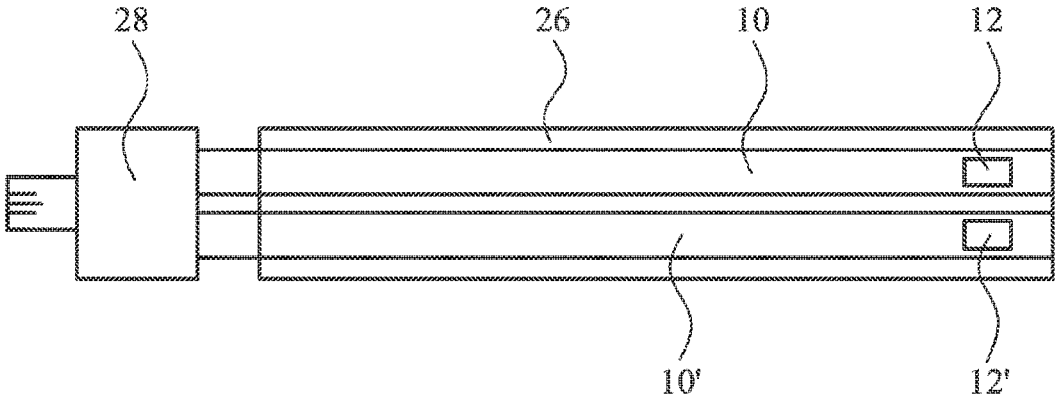
FIG. 4 is a schematic view of two fibers according to the present invention attached to fabric tape.
Figure 5:
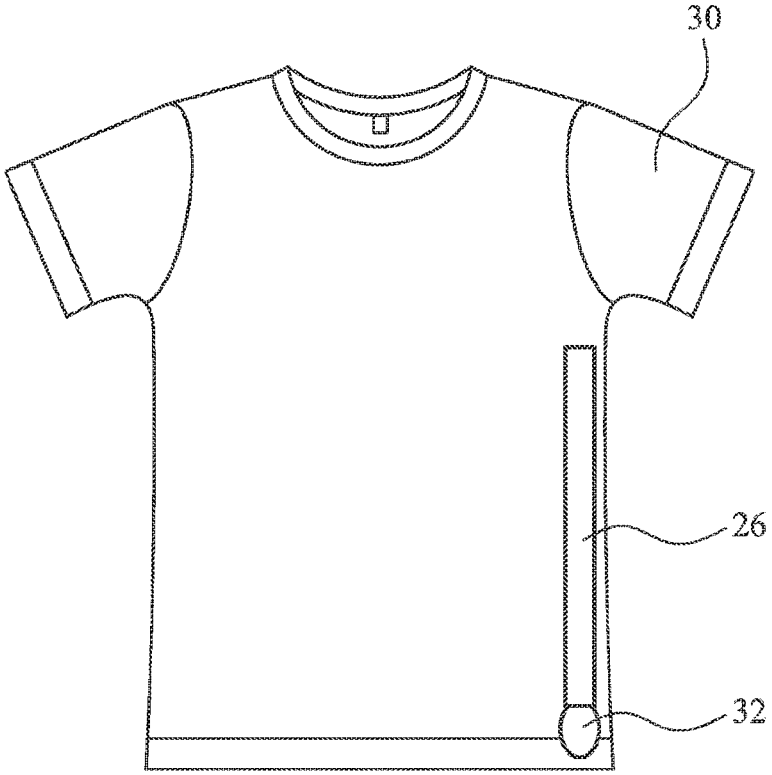
FIG. 5 is a schematic view of a first embodiment of a textile according to a second aspect of the present invention, in the form of a garment, incorporating the fabric tape of FIG. 4.

An example use of the fiber 10 is shown schematically in FIGS. 4 and 5.

As shown in FIG. 4, first 10 and second 10' fibers are attached to fabric tape or ribbon 26. One side of the fabric tape that is not contact with skin of a user is provided with a thermally insulating material (not-shown) in the region of the temperature sensors 12, 12' of the first 10 and second 10' fibers. Thus the temperature sensors 12, 12' are shielded from ambient conditions when the fabric tape 26 is attached to a garment 30. The first 10 and second 10' fibers are provided at one end with a connection member 28, for connection to a Bluetooth transmitting device 32.

As shown in FIG. 5, the fabric tape 26 is attached to the inside of a underwear t-shirt 30, such that the thermally insulating material contacts the fabric of the t-shirt 30, and the temperature sensors 12,12' are exposed to the interior of the t-shirt 30. The first 10 and second 10' fibers are connected to a Bluetooth transmitting device 32 via the connection member 28. When the t-shirt 30 is worn, the temperature sensors 12, 12' are able to sense the temperature of the body of the wearer, and are able to relay this information to a remote monitoring location via the Bluetooth transmitting device 32.

Figure 6:
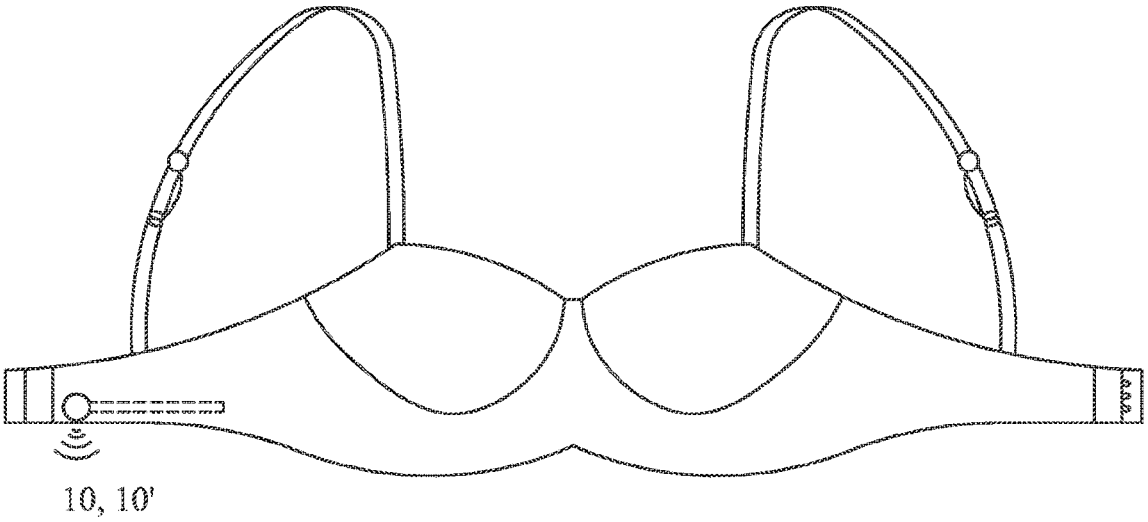
FIG. 6 is a schematic view of a second embodiment of a textile according to a second aspect of the present invention, in the form of a garment, incorporating the fiber of FIG. 1.

Another embodiment of a garment incorporating the first 10 and second 10' fibers is shown schematically in FIG. 6. The garment is a bra, which incorporates the first 10 and second 10' fibers in a similar manner to the t-shirt 30 shown in FIG. 5.

Such applications may be particularly useful in both the sporting and medical fields. In particular, in the sporting field, the fiber 10 of embodiments of the present invention may be used to provide real time feedback of an athlete's performance and/or body vitals. In the medical field, the fiber 10 of embodiments of the present invention may be incorporated into a garment intended to be worn by an infant. The body temperature of the infant may be monitored using fibers according to embodiments of the present invention, and relevant data can be transmitted to, for example, a parent, or a clinician. In such a manner, rises or falls in the body temperature of the infant can be immediately notified to the relevant persons, such that the relevant person can then take action should such action be necessary. The fiber 10 may be used in a garment for adults and/or elderly patients in a similar manner.

Figure 7:
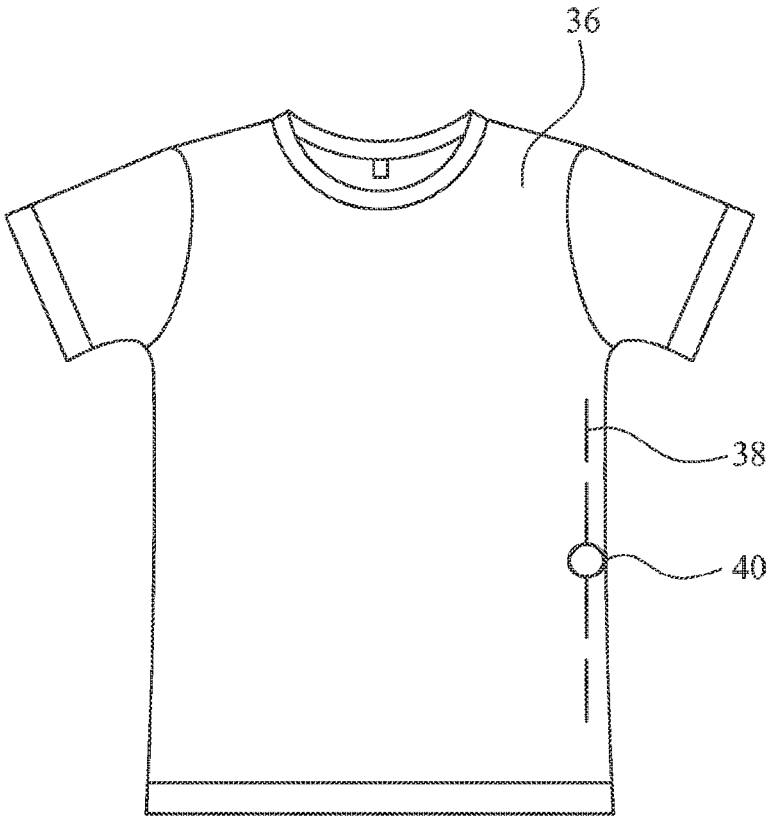
FIG. 7 is a schematic view of a third embodiment of a garment according to a second aspect of the present invention, in the form of a garment, incorporating the fiber of FIG. 1.

A further embodiment of a garment incorporating a fiber according to embodiments of the present invention is shown in FIG. 7. In this embodiment, the garment 36 is a t-shirt 36, which has a fiber 38 sewn into its side seam. The fiber 38 differs from the fibers 10, 10' previously discussed, in that the fiber 38 has an RFID sensor 40 instead of a temperature sensor 12,12'.

Figure 8:
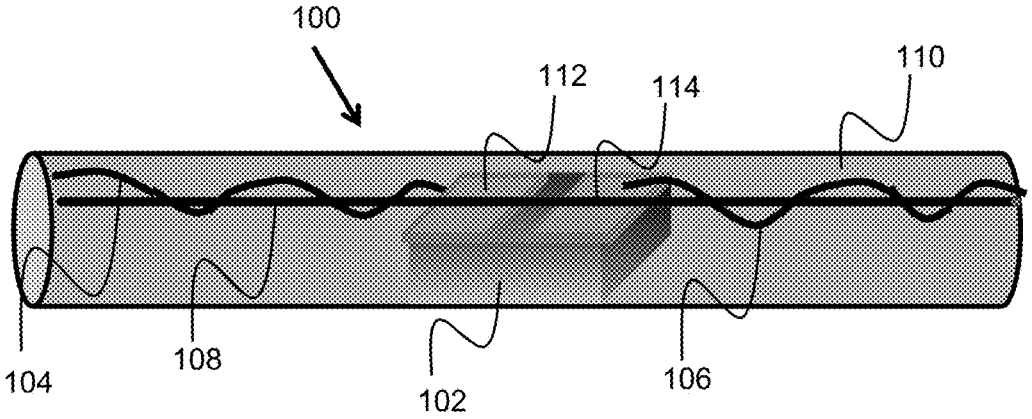
FIG. 8 is a schematic view of a second embodiment of a fiber according to the first aspect of the present invention.

A second embodiment of a fiber according to embodiments of the present invention, generally designated 100, is shown schematically in FIG. 8.

The fiber 100 comprises an electronic device 102, first 104 and second 106 electrical conductors, a reinforcing thread 108, a resin body 110, and first 112 and second 114 electrical connectors.

The electronic device 102 may be any appropriate electronic device, but in the present case is a temperature sensor 12. The first 104 and second 106 electrical conductors are formed from copper wire, and are electrically connected to the first 112 and second 114 electrical connectors of the temperature sensor 102. The first 104 and second 106 electrical conductors extend across the entire length of the fiber 100, as shown in FIG. 8.

The reinforcing thread 108 extends across the entire length of the fiber 100, as shown in FIG. 8. The reinforcing thread 108 may be formed of any material sufficient to reinforce the fiber 100, and in the present case is formed from nylon. The first 104 and second 106 electrical conductors are wound around the reinforcing thread 108 in a helical manner.

The resin body 110 encapsulates each of the temperature sensor 102, the first 104 and second 106 electrical conductors, the reinforcing thread 108, and the first 112 and second 114 electrical connectors such that the resin body 110 forms an outermost layer of the fiber 100. In this manner, the resin body 110 prevents exposure of the remaining components to the external environment of the fiber 100. Furthermore, and as seen in FIG. 8, the resin body 110 forms a main body of the fiber 100 along the length of the fiber 100.

Figure 9:
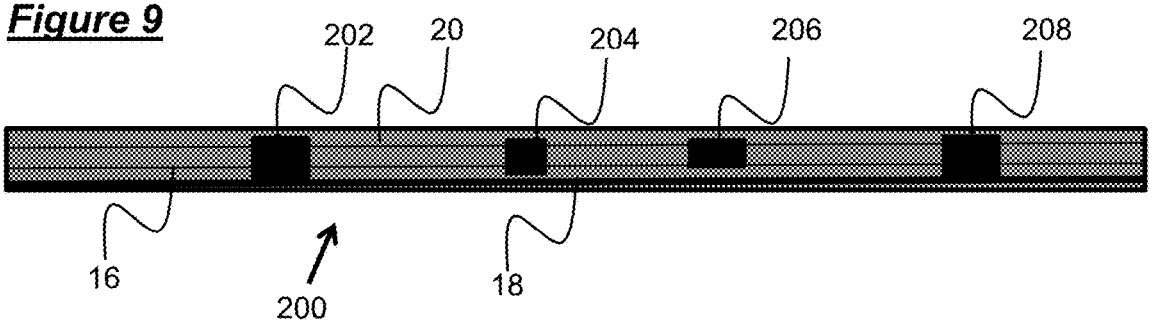
FIG. 9 is a schematic longitudinal sectional view of a third embodiment of a fiber according to the first aspect of the present invention.

A third embodiment of a fiber according to embodiments of the present invention, generally designated 200, is shown schematically in FIG. 9. The third embodiment of the fiber 200 is substantially the same as the first embodiment 10, and differs only in that the fiber 200 has a plurality of different electronic devices 202, 204, 206, 208 encapsulated therein.

Figure 10:
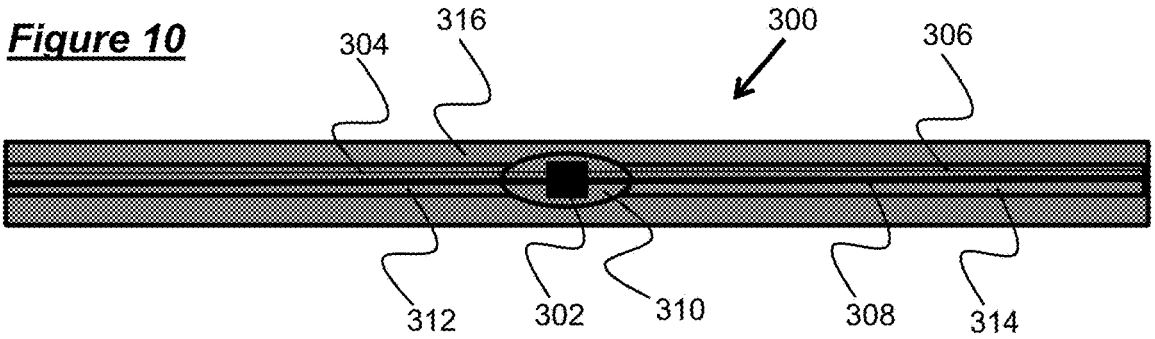
FIG. 10 is a schematic longitudinal sectional view of a fourth embodiment of a fiber according to the first aspect of the present invention.

A fourth embodiment of a fiber according to embodiments of the present invention, generally designated 300, is shown schematically in FIG. 10.

The fiber 300 comprises an electronic device 302, first 304 and second 306 electrical conductors, a reinforcing thread 308, and first 310, second 312, third 314, and fourth 316 resin bodies.

The electronic device 302 in the fourth embodiment is an RFID tag. The first 304 and second 306 electrical conductors are formed from copper wire, and are electrically connected to the RFID tag 302. The first 304 and second 306 electrical conductors extend across the entire length of the fiber 300, as shown in FIG. 10.

The reinforcing thread 308 extends across the entire length of the fiber 300, as shown in FIG. 10. The reinforcing thread 308 may be formed of any material sufficient to reinforce the fiber 300, and in the present case is formed from nylon.

The first resin body 310 is formed of epoxy resin and encapsulates the RFID tag 302, along with portions of the first 304 and second 306 electrical conductors, and a portion of the reinforcing thread 308. The use of epoxy resin for the first resin body 310 may be beneficial as it may provide a region of relatively high structural strength about the RFID tag 302.

The second 312 and third 314 resin bodies are formed of an electrically insulating resin, and encapsulate the remainder of the first 304 and second 306 electrical conductors and the reinforcing thread 308 either side of the RFID tag 302.

The fourth resin body 316 encapsulates the first 310, second 312, and third 314 resin bodies, such that the fourth resin body 314 defines an outer layer of the fiber 300, and is formed from a resin which is more flexible than the resin of the first 310, second 312, and third 314 bodies of resin, for example polyurethane or silicone elastomer.

The use of different resins for the first 310, second 312, third 314 and fourth 316 bodies of resin may allow resins having different material properties, eg structural strength, flexibility, heat/electrical conduction, to be chosen dependent on the application of the fiber 300, whilst still ensuring that the electronic device (eg the RFID tag 302) and the electrical conductors 304, 306 are encapsulated, thereby preventing exposure to ambient conditions.

Figure 11:
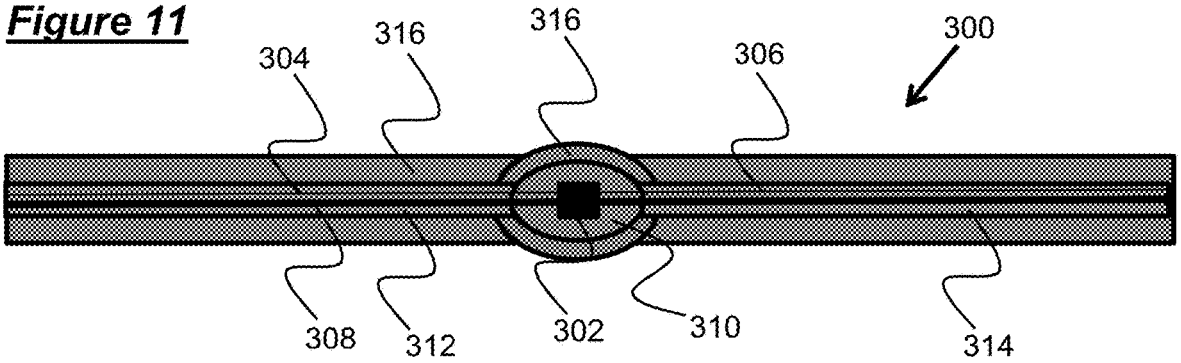
FIG. 11 is a schematic longitudinal sectional view of a fifth embodiment of a fiber according to the first aspect of the present invention.

A fifth embodiment of a fiber according to embodiments of the present invention is shown schematically in FIG. 11. The fifth embodiment of the fiber is substantially identical to the fourth embodiment of the fiber 300, and hence the reference numerals used for the fourth and fifth embodiments of the fiber 300 are the same. The fifth embodiment differs from the fourth embodiment only in that the fourth resin body 316 in the region of the RFID tag 302 is thicker relative to the remaining regions of the fourth resin body 316 along the length of the fiber 300. This region of increased thickness may, for example provide increased thermal resistance or increased mechanical strength in the region of the RFID 302.

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

The invention claimed is:

1. A fiber for incorporation into a textile, the fiber comprising:

an electronic device; and an electrical conductor connected to the electronic device and extending along a longitudinal axis of the fiber, wherein the electronic device and the electrical conductor are encapsulated by a unitary body of at least a first material;

wherein the fiber comprises a reinforcing member for reinforcing the fiber, and the electrical conductor is wound around the reinforcing member.

2. The fiber as claimed in claim 1, wherein the unitary body comprises a first material that encapsulates both the electronic device and the electrical conductor, or a first material that encapsulates the electronic device that is bonded, as a single body, to a second material that encapsulates the electrical conductor.

3. The fiber as claimed in claim 1, wherein the unitary body comprises a plurality of materials in a layered structure.

4. The fiber as claimed in claim 1, wherein the unitary body comprises an inner layer of at least the first material, which is in contact with the electronic device and/or the electrical conductor, and an outer layer that extends about the inner layer.

5. The fiber as claimed in claim 4, wherein the inner layer is configured to protect the electronic device and/or the electrical conductor, the inner layer having a greater rigidity, a greater thermal resistance and/or a greater electrical resistance relative to the outer layer.

6. The fiber as claimed in claim 4, wherein a material of the outer layer has an inherently greater flexibility relative to the inner layer.

7. The fiber as claimed in claim 4, wherein a material of the inner layer is translucent or transparent.

8. The fiber as claimed in claim 1, wherein the reinforcing member comprises a thread extending along the longitudinal axis of the fiber.

9. The fiber as claimed in claim 1, wherein the reinforcing member comprises a thread extending along at least 70% of a longitudinal axis of the fiber.

10. The fiber as claimed in claim 1, wherein the electrical conductor is fixed to the reinforcing member, prior to encapsulation by the first material.

11. The fiber as claimed in claim 1, wherein the fiber has a width or diameter of at most 2000 μm.

12. The fiber as claimed in claim 1, wherein the fiber has a width or diameter which is at least 200% of the width or diameter of the electrical conductor.

13. The fiber as claimed in claim 1, wherein the first material comprises a resin.

14. The fiber as claimed in claim 1, wherein the first material has a thermal conductivity of at least 0.1 W/(m·K).

15. The fiber as claimed in claim 1, wherein the electronic device comprises at least one of: a controller, a sensor, a transmitter and/or a receiver of electrical or electromagnetic signals, and a memory for storing data.

16. The fiber as claimed in claim 1, wherein the fiber comprises a plurality of electronic devices, each of the plurality of electronic devices connected to at least one electrical conductor, the plurality of electronic devices and the electrical conductors being encapsulated by the unitary body of at least a first material.

17. The fiber as claimed in claim 16, wherein the electrical connectors are encapsulated by the unitary body of at least a first material along the entire length of the electrical connectors.

18. A textile incorporating a fiber as claimed in claim 1.

19. A method of manufacturing a fiber for incorporation into a textile, the method comprising connecting an electrical conductor to an electronic device, winding the electrical conductor around a reinforcing member, and encapsulating the electronic device and the electrical conductor in a unitary body of at least first material, such that the electrical conductor extends along a longitudinal axis of the fiber.

20. A method of manufacturing a textile, the method comprising incorporating a fiber according to claim 1 into the textile.

* * * * *